United States Patent [19]

Ohashi et al.

[11] 4,298,050

[45] Nov. 3, 1981

[54] PROCESS FOR CONTINUOUS CASTING OF A SLIGHTLY DEOXIDIZED STEEL SLAB

[75] Inventors: Tetsro Ohashi; Osamu Kitamura; Hiromu Fujii; Seizo Mineyuki; Eiichi Takeuchi, all of Himeji, Japan

[73] Assignee: Nippon Steel Corporation, Tokyo, Japan

[21] Appl. No.: 91,813

[22] Filed: Nov. 6, 1979

[30] Foreign Application Priority Data

Nov. 6, 1978 [JP] Japan ..... 53/135776
Sep. 10, 1979 [JP] Japan ..... 54/116030

[51] Int. Cl.[3] ..... B22D 27/02; B22D 11/00

[52] U.S. Cl. ..... 164/468; 164/418; 164/467; 164/473; 164/474

[58] Field of Search ..... 164/82, 55, 56, 64, 164/49, 147, 418

[56] References Cited

U.S. PATENT DOCUMENTS 3,952,791 4/1976 Ito et al. ..... 164/49
4,042,007 8/1977 Zavaras et al. ..... 164/147

*Primary Examiner*—Robert D. Baldwin
*Assistant Examiner*—K. Y. Lin
*Attorney, Agent, or Firm*—Wenderoth, Lind & Ponack

[57] ABSTRACT

In the continuous casting of steel, it has been possible to produce killed steel industrially, but semikilled and rimmed steel have not been successfully produced due to rimming action occurring in the oscillating mold. The present invention involves a concept of suppressing the nuclei of bubbles which will later grow into CO bubbles. In order to suppress the nuclei of bubbles and to form a non-defective solidification layer of a continuously cast strand, the present invention provides a combination of a free oxygen concentration of from 50 to 200 ppm in the molten steel; a concave shape at the short sides of the mold; a propulsion forces of the molten steel directed along the long sides of the mold in directions opposite to one another; subjecting a solidification interface to an electromagnetic flow having a speed of from 0.1 to 1.0 m/sec, and; solidifying the molten steel at the solidification interface under the influence of the electromagnetic flow, until a non-defective solidification layer without blow holes is obtained.

11 Claims, 21 Drawing Figures

PROCESS FOR CONTINUOUS CASTING OF A SLIGHTLY DEOXIDIZED STEEL SLAB

The present invention relates to a process for producing by continuous casting a so-called slightly deoxidized steel, which is very similar to rimmed or semikilled steels.

Attempts have been made for many years to produce steels corresponding to rimmed and semikilled steels by continuous casting. However, such continuously cast steels have not been practically produced to date because of problems in the continuous casting operation and the steel quality, especially the defect of blow holes on the surface of the slab. Such phenomenon as the rimming action occurring in the conventional ingot casting presents, in the powder-casting operation, which is adopted in most of the modern continuous casting processes, difficulties in production, such as breakout and the like. Prior to continuous casting deoxidation is, therefore, controlled so as not to cause the rimming action. However, when the amount of free oxygen in the deoxidation adjusted molten steel is more than from approximately 50 to 70 ppm at a solidication temperature of from 1520° to 1550° C., blow holes are caused on the surface of a strand. These blow holes are exposed to the ambient air prior to the rolling and are left as surface flaws on the rolled products, because the inner surfaces of the blow holes are oxidized by the ambient air. The oxygen concentration mentioned above can be measured by an oxygen concentration cell using a zirconium dioxide ($ZrO_2$) stabilized by a calcium oxide (CaO) as a solid electrolyte, a mixture of chromium and a chromium oxide ($Cr_2O_3$) as a standard electrode and iron (Fe) as a counter electrode.

In the present state of the art of continuous casting of steels corresponding to the rimmed or semikilled steels, the steels are excessively deoxidized by means of the deoxidant or vacuum degassing so as to prevent the rimming action from occurring. As a result, the high production rate of the continuous casting is completely utilized. On the other hand, in several reports, attention is directed to the fact that the surface defects of blow holes on the strand are caused by insufficient rimming action for removing the blow holes. In these reports processes are proposed for assisting the rimming action of the slightly deoxidized steel or the incompletely deoxidized steel. In the proposed processes, the molten steel is subjected to an electromagnetic stirring force within the mold. These processes are divided into a process wherein the molten steel within the mold is stirred in a horizontal or vertical direction by means of an electromagnetic stirring device installed in the interior of the mold, so that a circulating flow or convection is created, and a process wherein the molten steel within the mold is stirred by means of an electromagnetic stirring device provided below the mold, so that a circulating flow is created. The prior art of the process of installing the electromagnetic stirring device in the mold interior includes Japanese Laid Open Patent Application (hereinafter referred to as JA-OS) No. 51-2621 and Japanese Published Patent Application (hereinafter referred to as JA-AS) No. 53-34164, while the prior art of the process of installing the electromagnetic device below the mold includes JA-OS No. 49-126523 and JA-OS No. 50-68915. When the molten steel within the mold is subjected to the electromagnetic stirring force so as to assist the rimming action, the following inconveniencies in a practical operation are caused. Since generated bubbles are moved upwards and removed by the effects of the rimming action in the processes mentioned above, the flow speed of molten steel required for floating the bubbles is relatively high. It should be noted here that the flow speed is dependent on the oxygen concentration in the molten steel. Since the oxygen level of the practically castable incompletely deoxidized or slightly deoxidized steels is lower than that required for an appreciable rimming action, a flow speed of approximately 3.0 m/sec may be required. However, when the bubbles are moved upwards or removed by a high flow speed, a disturbance of the molten steel surface is caused by the vigorous stirring movement of the molten steel within the mold. The continuous casting powder, which should be present on the molten steel surface, has the purposes of: lubrication between the mold and the strand; prevention of a decrease in the temperature of molten steel; prevention of reoxidation of the molten steel, and; absorption of inclusions contained in the molten steel. The disturbance of the molten steel surface in turn causes the disturbance of the continuous casting powder on the molten steel surface, with the result that the essential functions of the powder are not exhibited, and also, such problems as entrapment of the powder and breakout may be caused. Since the continuous casting powder on the molten steel surface in the mold is indispensable for the currently conducted continuous casting, it is essential to prevent the disturbance of the molten steel surface. Accordingly, the method of floating removal of bubbles due to rimming action is impractical in the currently conducted continuous casting, which is based on powder casting, because the disturbance of the molten steel surface unavoidably occurs. Regarding the floating removal method, it is to be noted that, although appreciable disturbance of the molten steel surface might not be caused in the case of a horizontal rotating flow, the stirring movement of the molten steel for floating removal of bubbles, which are generating and growing, must be performed at an extremely high speed of flow and the stirring flow rotates the powder on the molten steel surface. As a result, the continuous casting powder is gradually accumulated at the central portion of the mold, and eventually no continuous casting powder exists at the interface between the molten steel and the mold walls. Consequently since the powder cannot flow between the mold and the solidified shell of steel so as to perform the necessary lubrication, a breakout may finally be caused.

The concept involved in the process disclosed in JA-OS No. 51-2621, mentioned above, is to impart the rotational flow to the entire molten steel in the mold and, therefore, the danger of powder entrapment is great. Since the currently conducted continuous casting is based on powder casting as explained above, the casting operation itself becomes difficult due to the imparting of a stirring force equivalent to the rimming action to the molten steel in the mold. Such stirring processes cannot, therefore, be adopted practically.

In a process disclosed in Belgian Pat. No. 864218, a linear motor is installed at both long sides of a slab mold, in such a manner that the propulsion forces by the linear motor are led into directions opposite to one another, thereby creating a horizontally rotating flow even in the central portion of the mold. The object of the disclosed process is to separate and remove inclusions from the molten steel by a centrifugal force, and not to prevent disturbance of the liquid surface. The process disclosed in this Belgian patent, in which even molten steel in the central portion of the mold undergoes the flowing movement, disadvantageously causes the disturbance of continuous casting powder on the molten steel surface. As a result, normal powder casting, on which the presently conducted continuous casting is based, is not performed in this disclosed process.

The prior art of continuously casting a steel with a high oxygen content by utilizing an electromagnetic stirring force includes JA-OS No. 51-122625, in addition to the prior art mentioned above. However, measures for preventing the disturbance of powder are not mentioned in JA-OS No. 51-122625.

The prior art in which an electromagnetic stirring device is disposed in various type molds includes JA-AS No. 51-9858, JA-AS No. 33-2768, JA-AS No. 47-32468, JA-AS No. 49-27487, JA-AS No. 53-8535, JA-AS No. 54-4325, JA-OS No. 50-150640, JA-OS No. 52-5625, JA-OS No. 52-60233, JA-OS No. 52-56015, JA-OS No. 52-88541, JA-OS No. 52-97327, JA-OS No. 53-25235, JA-OS No. 53-26731, JA-OS No. 53-28033, JA-OS No. 53-28034, JA-OS No. 53-88631, JA-OS No. 53-113225, JA-OS No. 53-142923, JA-OS No. 53-142924, JA-OS No. 54-4241, U.S. Pat. No. 3,153,820, U.S. Pat. No. 3,995,678, U.S. Pat. No. 4,042,007, Belgian Pat. No. 27898 and Belgian Pat. No. 27899. The prior art mentioned above basically disclose measures for preventing entrapment of inclusions or slags into a solidifying shell of a strand, but not concrete measures for preventing the disturbance of the continuous casting powder.

It is, therefore, an object of the present invention to remove the disadvantages of the known processes for producing incompletely deoxidized or slightly deoxidized steels by continuous casting, and to make it possible to continuously cast these steels with neither rimming action occurring in the molten steel within the mold, nor surface defects on the strand, thereby achieving the merits of producing the steels mentioned above by continuous casting and, at the same time, decreasing the amount of deoxidant used for the production of a unit of steel.

It is another object of the present invention to make it possible to continuously cast incompletely deoxidized or slightly deoxidized steels, without eliminating the merits achieved by the normally conducted powder casting at present.

It is an object of an embodiment of the present invention not to create a disturbance at the solidification interface, explained hereinbelow, by an ejected stream from outlet ports of a regularly adopted immersion nozzle.

In accordance with the present invention there is provided a process for continuous casting of a slab of slightly deoxidized steel, wherein a continuous casting powder and a nozzle immersed into molten steel within a mold are used, characterized by the combination of:

casting into the mold molten steel having a concentration of free oxygen in the molten steel in the range of from 50 to 200 ppm;

providing the inner surface of both short sides of said mold with a concave shape seen in the horizontal cross section of the short sides;

locating a device for generating an electromagnetic force at each of both long sides of the mold and above an outlet port of the immersion nozzle;

orienting the propulsion force of the device for generating the electromagnetic force in directions along said long sides opposite to one another;

energizing the device for generating a flow of molten steel having an essentially constant flow speed, said flow horizontally rotating entirely around a solidification interface and in the proximity thereof, and being formed from the position of a molten steel surface within the mold to the proximity of a predetermined vertical position of said solidification interface, and;

providing said horizontal flow with a flow speed in the range of from 0.1 to 1.0 m/sec.

The present invention will be explained in detail with reference to the drawings, in which.

Figure 11:
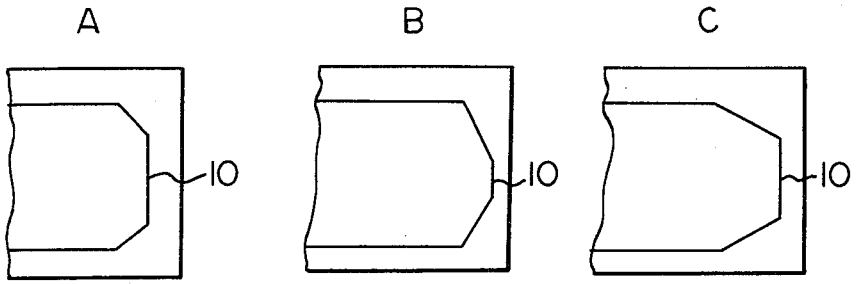
Figure 12:
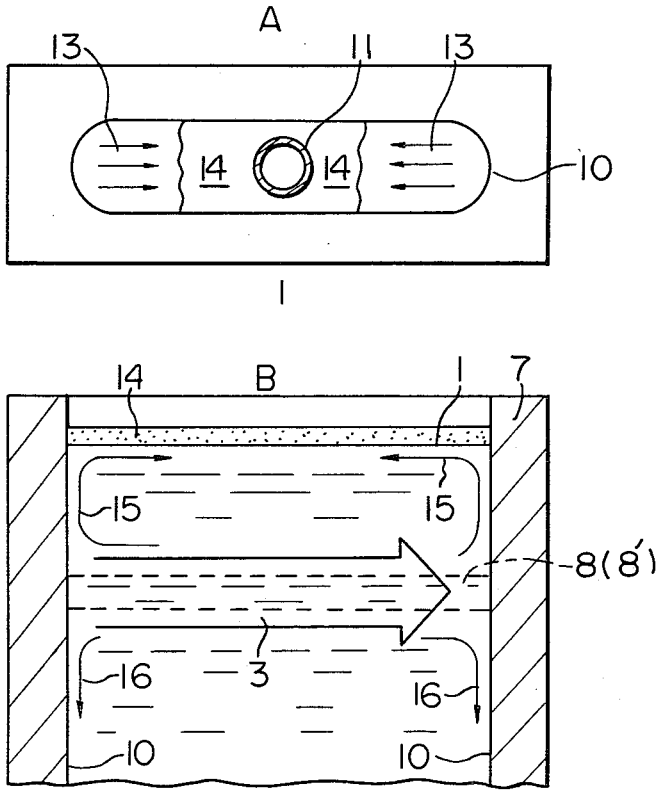
Figure 13:
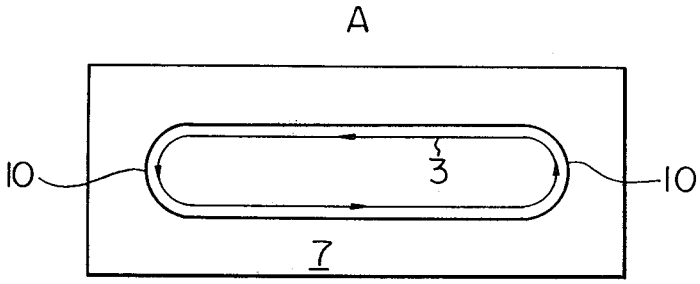
Figure 13:
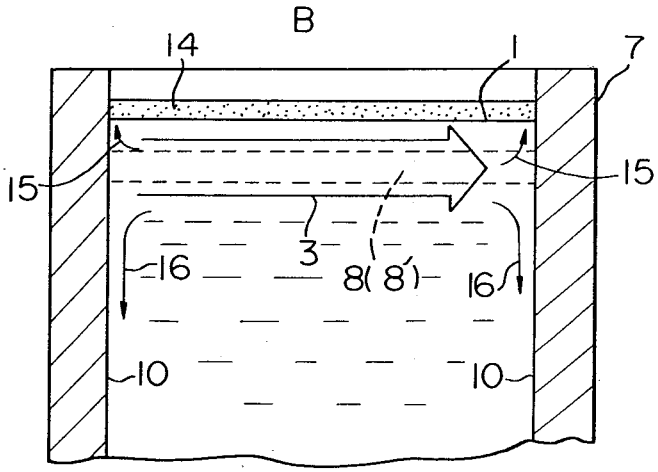
Figure 14:
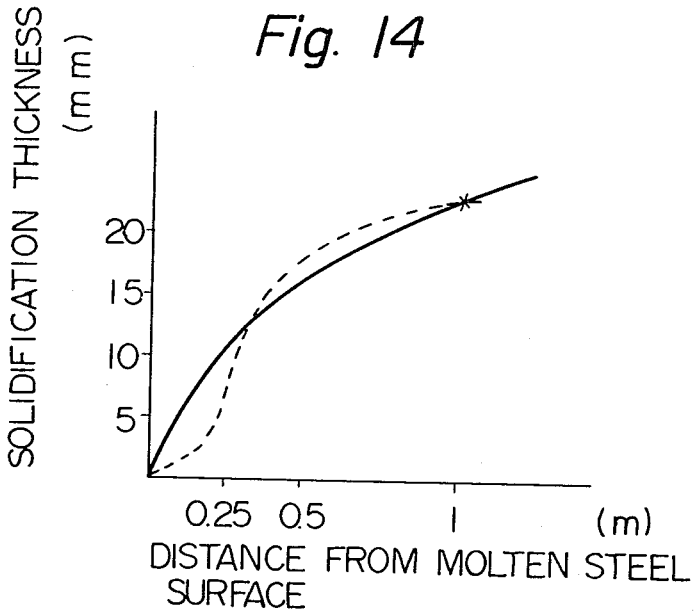
Figure 15:
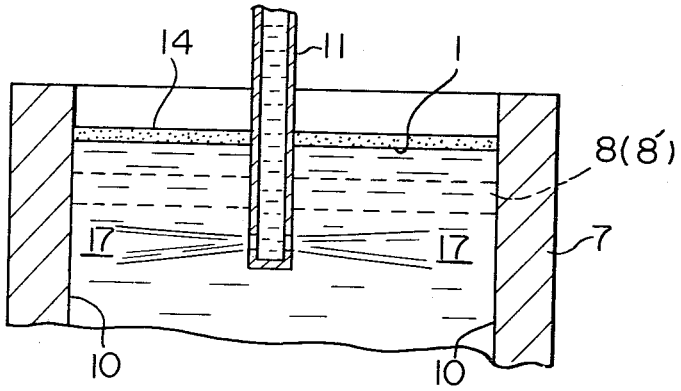
Figure 16:
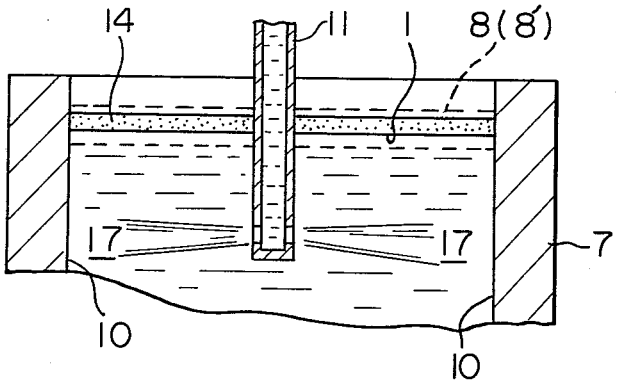
Figure 17:
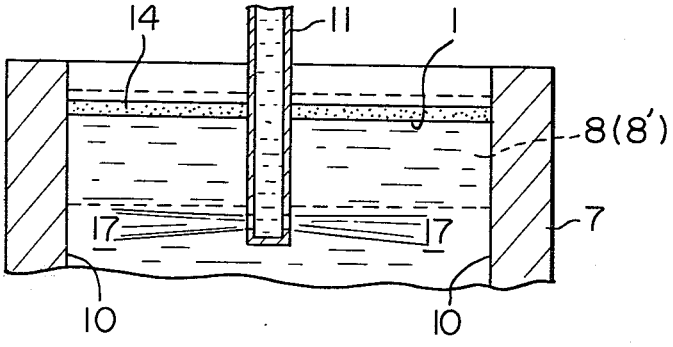
Figure 18:
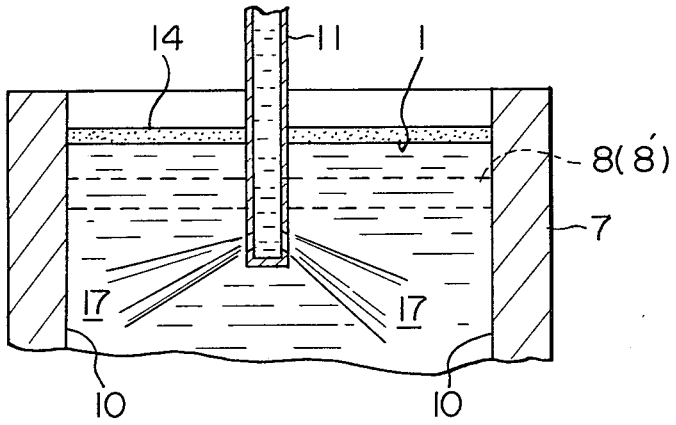
Figure 19:
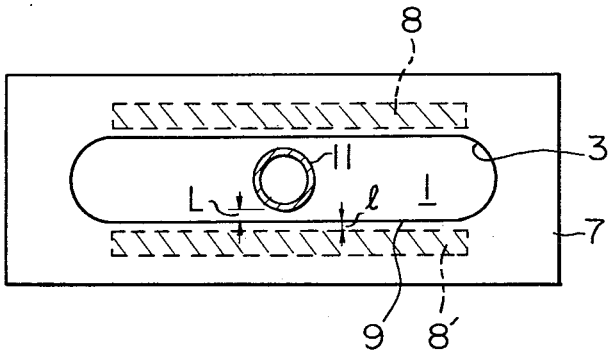
Figure 20:
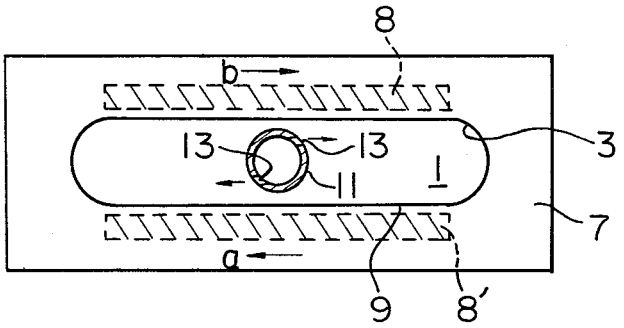
Figure 21:
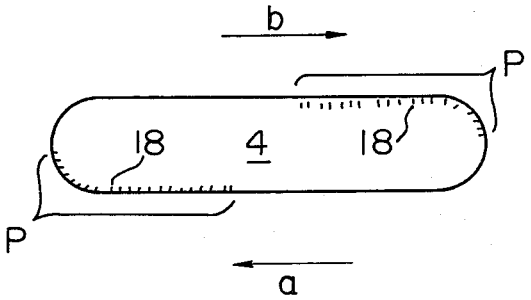

FIGS. 11 A, B, and C are partial plan views of the molds which can be used in the present invention;

FIGS. 12 A and B are a plan view and a vertical cross sectional view of a mold, respectively, and illustrate a flow of molten steel moving toward the center of the mold;

FIGS. 13 A and B are drawings similar to FIGS. 12A and B, respectively, and illustrate a horizontal rotational flow;

FIG. 14 is a graph of the thickness of a solidification layer;

FIG. 15 is a partial cross sectional view of a mold;

FIGS. 16 and 17 are partial cross sectional views of a mold and an immersion nozzle with horizontal outlet ports;

FIG. 18 is a partial cross sectional view of a mold and an immersion nozzle with downward outlet ports;

FIG. 19 is a plan view of a mold;

FIG. 20 is a drawing similar to FIG. 19, and;

FIG. 21 is a schematic illustration of the macroscopic structure of a strand.

Figure 1:
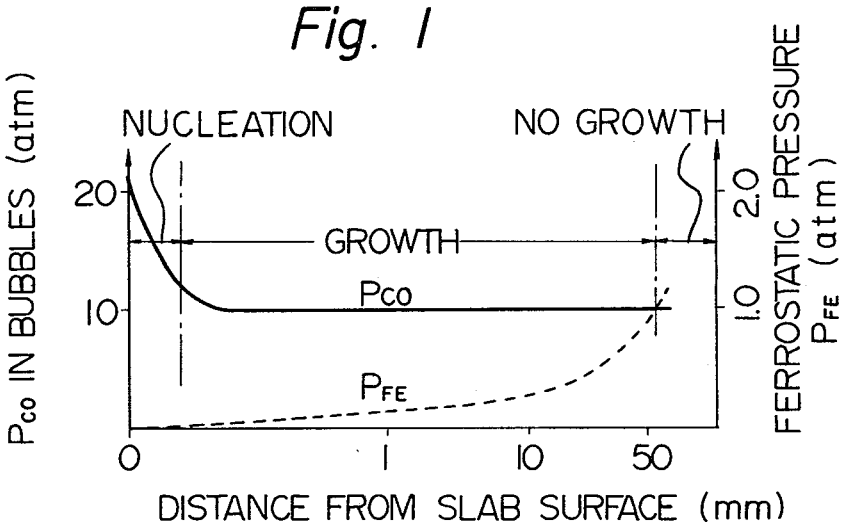
FIG. 1 is a graph for illustrating a formation mechanism of bubbles.
Figure 2:
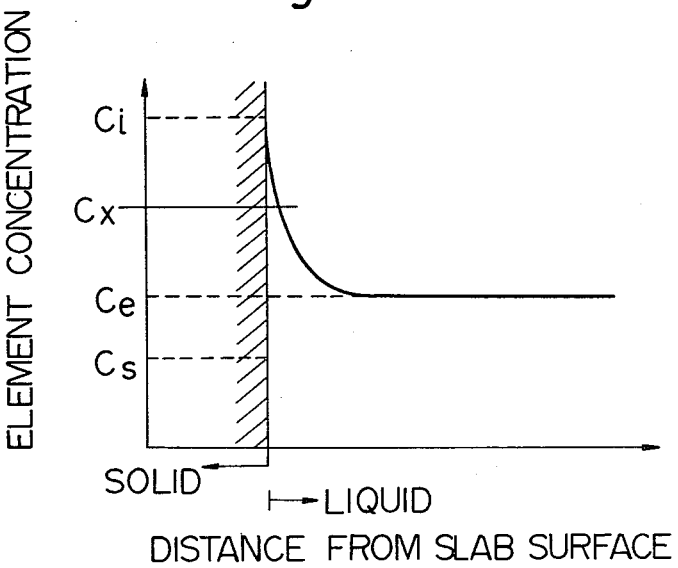
FIG. 2 is a graph of the distribution of the concentration of the elements in steel.

The present Inventors firstly investigated in detail the factors involved in generation of bubbles on the strand surface during the solidification of a molten steel having a low deoxidation degree. Referring to FIG. 1, the formation procedure of the bubbles during solidification is divided into a stage denoted as NUCLEATION, in which the nuclei of the bubbles are generated, and a stage denoted as GROWTH, in which the nuclei are grown to bubbles. As seen in FIG. 1, a partial pressure $P_{co}$ in the bubbles already generated of approximately 1 atm or more ($P_{co} \simeq 1$ atm) is sufficient for the further growth of the bubbles, although a partial pressure $P_{co}$ of from approximately 2 to 3 atm ($P_{co} \simeq 2$ 3 atm) is necessary for the nucleation at the solidification interface. This fact means that, although the nuclei of bubbles are difficult to generate, the already generated nuclei can easily grow into bubbles. The growth of the bubbles is terminated when the ferrostatic pressure $P_{Fe}$ of the molten steel exerted on the bubbles exceeds the partial pressure $P_{co}$. The generation of nuclei of bubbles, which later grow into bubbles, is mainly influenced by the concentration of carbon and oxygen in the molten steel. As will be understood from FIG. 2, the component elements in the molten steel are concentrated at the solidification interface, i.e. the interface between the solid and liquid, while the solidification proceeds. In FIG. 2, $C_i$ indicates the element concentration at the solidification interface, $C_s$ indicates the element concentration in the solid phase and $C_e$ indicates the element concentration in the liquid phase.

The critical concentration required for the generation of nuclei of bubbles is denoted in FIG. 2 by $C_x$. Even in a case where the element concentration $C_e$ in the liquid does not arrive at the concentration $C_x$, the concentration $C_i$ may exceed $C_x$, due to the concentration phenomenon mentioned above, and the generated nuclei will later grow to bubbles, which are exposed on the surface portion of the strand. This fact implies that: the generation of nuclei, which later grow to bubbles, commences even at the beginning of the solidification of molten steel, namely at the molten steel surface within the mold, and; in order to suppress the generation of nuclei of bubbles, the element concentration at the solidification interface at the molten steel surface in the mold must be controlled so that it is below the critical concentration $C_x$ of the nuclei generation of bubbles. The results of research by the present Inventors are as follows.

A. The nuclei of bubbles are difficult to generate as compared with the growth thereof and the generation of the nuclei of bubbles requires more than a certain concentration of the elements.

B. The nuclei of bubbles are already generated at the solidification beginning point, namely at the solidification interface at the molten steel surface within the mold.

C. The concentration of elements, such as carbon and oxygen, is relatively very high at the solidification interface.

The facts A, B and C, above, were taken note of when creating the present invention, which provides measures to reduce the concentration of elements at the solidification interface in the neighborhood of the molten steel surface within the mold to a level less than the critical concentration of the generation of nuclei of bubbles, while causing no disturbance of the molten steel surface.

Figure 3:
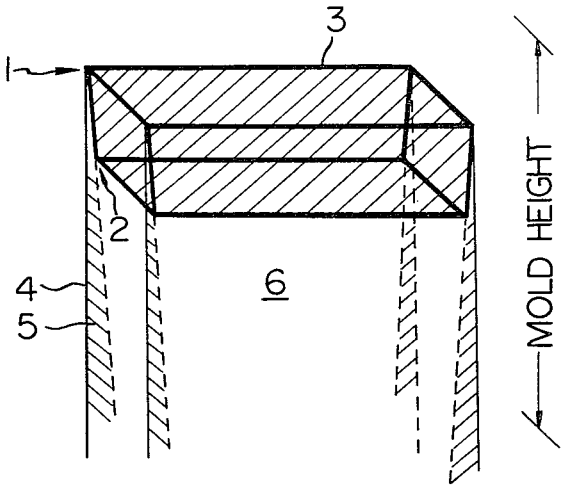
FIG. 3 is a schematic illustration of the strand being cast and illustrates a principle of the present invention.
Figure 4:
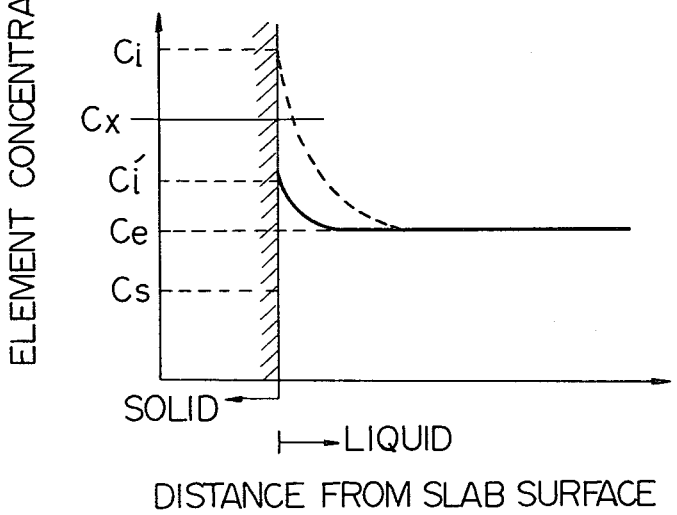
FIG. 4 is a graph similar to FIG. 2.

In the present invention, a rotational flow of molten steel in the form of a film is formed as shown by the hatched sides of the solidification interface defined by the frame-like bold lines in FIG. 3. The rotational flow, hereinafter denoted by the reference numeral 3, is: formed around essentially the entire perimeter of a solidification interface 2; limited to only around the perimeter of the solidification interface, namely not extended toward the interior of the molten steel, and; formed in the neighborhood of a molten steel surface 1 in the mold. Due to the filmy rotational flow of molten steel, a strand 4 which is produced is provided at the surface portion thereof with a non-defective solidification layer 5, in which the element concentration is less than the critical limit for generating nuclei of the bubbles. It is to be noted that: since the molten steel at the circumference of the solidification interface in the neighborhood of the molten steel surface is rotated during the casting, the concentration phenomenon of the component elements in the molten steel can be suppressed, and; since the imparted flow of the molten steel is in the form of a film formed only at the circumference of the solidification interface, no disturbance of the molten steel surface and the continuous casting powder on the molten steel surface is caused by the flow of molten steel. Referring to FIG. 4, although the concentration $C_i$ of the molten steel at the rest state (dotted line) is more than the critical concentration $C_x$ for the generation of nuclei of bubbles, the concentration is reduced to a value $C_i'$, which is less than $C_x$, by subjecting the solidification interface to the filmy flow.

In accordance with the present invention, the incompletely deoxidized and slightly deoxidized steels provided with a non-defective solidification layer without blow holes on a strand surface, are steels falling within the range of the following points of deoxidation degree. Below the minimum point of oxygen concentration, blow holes including pin holes are generated on the surface of the strand, which is cast without imparting any flow to the molten steel. This minimum point is dependent upon the operational conditions, such as the components other than oxygen, the temperature of the molten steel and casting speed, and corresponds, in most operating conditions, to an oxygen concentration of approximately from 50 to 60 ppm at a solidification temperature ranging from 1520° to 1530° C. Above the maximum point of oxygen concentration, the casting operation can be inconveniently regulated. When the oxygen concentration is too high, the rimming action is caused to occur in the mold, so that not only does the so generated serious disturbance of the molten steel surface impede the normal powder casting but, also, the casting operation itself is impossible in the worst case. The minimum oxygen concentration, for generating the rimming action corresponds to approximately 200 ppm of oxygen. The incompletely deoxidized and slightly deoxidized steels mentioned herein refer to steels having an oxygen concentration, in terms of free oxygen concentration, of not less than 50 ppm and not more than 200 ppm. The oxygen concentrations mentioned above are measured by an oxygen concentration cell using a zirconium dioxide ($ZrO_2$) stabilized by calcium oxide (CaO) as a solid electrolyte, a mixture of chromium (Cr) and chromium oxide ($CrO_2$) as a standard electrode and iron (Fe) as a counter electrode.

When the steel to be cast has an oxygen content of more than 200 ppm, i.e. the maximum value, the steel should be subjected to carbon deoxidation in a vacuum degassing method, or deoxidation by deoxidants such as Al, Si, Ca and the like, and after adjusting the oxygen concentration to a level less than the maximum point, the steel is subjected to the casting process of the present invention.

In the present invention, the entire circumference of the solidification interface in the neighborhood of the molten steel surface in the mold is subjected to the rotational flow of molten steel having a flow speed as explained hereinafter. The flow speed of molten steel required for the suppression of the nuclei of bubbles is only such that the concentration of elements at the solidification interface is decreased to a level less than the concentration of elements required for the nuclei generation. Accordingly, the flow speed in the present invention may be considerably slower than the flow speed for removing the bubbles in the conventional processes. The maximum flow speed is approximately 1.0 m/second. In other words, even by a slow speed of less than approximately 1.0 m/second the concentration of elements at the solidification interface can be decreased to a level less than that required for nuclei generation. When the flow speed exceeds approximately 1.0 m/second, the flowing movement, which may be a rotational movement around the entire circumference of the solidification interface in the mold, tends to cause disturbance of the molten steel surface or of the continuous casting powder on the molten steel surface. The maximum flow speed is, therefore, regulated so as not to induce disturbance of the molten steel surface and the continuous casting powder. The minimum flow speeds are in the range of from 0.1 to 0.4 m/second. Below the minimum flow speeds, the desired effects of the concentration decrease cannot be achieved. The flow speed according to the present invention is slow and is in the range of from 0.1 to 1.0 m/second, preferably in the range of from 0.5 to 0.8 m/second. The flow speed within these ranges should be a constant value over the entire solidification interface. Although the flow speed of the present invention may partly overlap the conventional flow speeds for removing bubbles, the present invention is directed toward a slow flow speed, because there is a difference in the mechanism of suppressing the bubbles between the present invention and the conventional processes for flowing molten steel. The concept of the present invention resides in the fact that the generation of nuclei is suppressed in a stage prior to growth of the nuclei into bubbles, while, in the concept of the conventional processes the already grown bubbles are moved upwards and then removed.

The depth of the rotational flow will now be explained. This depth has a relationship to the thickness of the non-defective surface solidification layer of a strand without blow holes. Theoretically, when the minimum non-defective solidification layer is present on the surface layer of a strand, and blow holes within the surface layer are pressed tightly during the subsequent rolling steps and present no problems in the practical use of the rolled product. However, practically speaking, since a considerable amount of scale off occurs until the rolling, for example, during the casting and in the heating furnaces, the blow holes may be exposed at the strand surface unless the scale off is taken into consideration. Since the amount of scale off is approximately from 0.7 to 5 mm, the rotational flow realized at the entire circumference of the solidification interface extends from the molten steel surface where the solidification initiates, to a depth where the solidification surface equal to the scale off amount is formed. The so imparted rotational flow is formed on the entire circumference of the solidification interface in the upper portion of liquid pool in the mold, and such rotational flow has a strip form wherein its width is in the vertical direction in the liquid pool. The position of the solidification layer having a thickness in the range of from 0.7 to 5 mm is dependent upon the casting speed, but is from approximately 50 to 200 mm below the molten steel surface when the casting condition is such as that usually adopted.

Regarding the thickness of the rotational flow mentioned above, such thickness is preferably as small as possible, so as to save energy and to decrease effects of the rotational flow on the molten steel surface to the lowest degree. Hereinafter, the thickness of the rotational flow will be explained.

Figure 5:
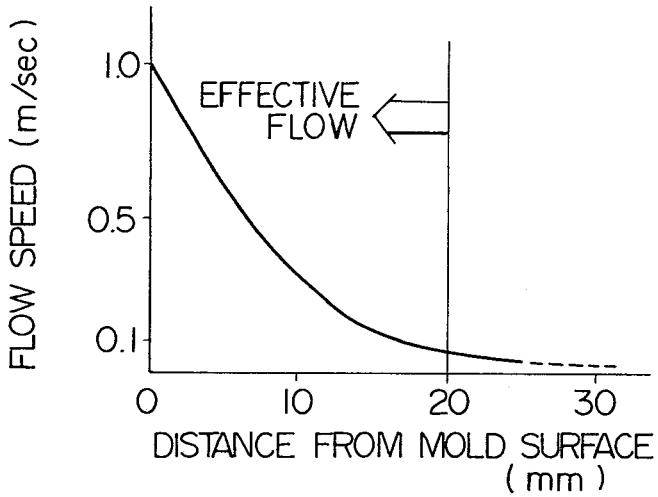
FIG. 5 is a graph of flow speed distribution.

Referring to FIG. 5, the flow within the mold has a distribution of speed depending upon distance from the mold wall. This distribution is dependent upon the propulsion force imparted by, for example, the flow-imparting device explained hereinbelow, and the thickness of the copper plate of the mold. When these conditions are properly adjusted, a flow speed of as high as 1.0 m/sec at the surface of the mold wall can be decreased to a value less than one half of 1.0 m/sec at a portion in the mold 10 to 20 mm distant from the surface of the mold wall, as exemplified in FIG. 5. Accordingly, a flow having a thickness of from 10 to 20 mm and being adjacent to the mold wall, is an essential portion of the flow which participates in the suppression of the nuclei of bubbles, and the flow distant from the mold wall by more than 20 mm exerts almost no influence on the behaviour of the molten steel surface. From the point of view of the function of suppressing the nuclei of bubbles, only a flow of molten steel having a thickness of from 10 to 20 mm participates in such function.

Figure 6:
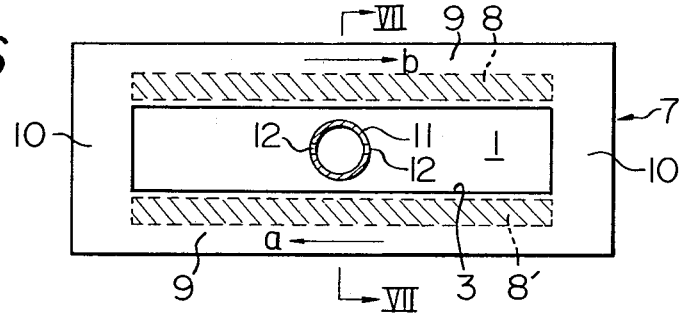
FIG. 6 is a plan view of a continuous casting mold.
Figure 7:
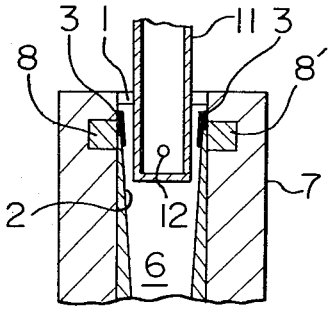
FIG. 7 is a cross sectional view along the line VII—VII in FIG. 6.

In the present invention, there is provided a concrete means for imparting a rotational flow to the molten steel which is present around the entire circumference of the solidification interface in the upper portion of the liquid pool within the mold. Such means is preferably a device for generating an electromagnetic force, especially a linear motor, which forms the rotational filmy flow, from the point of view of economy and stability. In the embodiment of the rotational flow imparting means illustrated in FIGS. 6 and 7, the linear motors 8 and 8' are located in the cooling boxes of both long sides 9 of the mold 7. The propulsion forces of the linear motors 8 and 8' are directed in the directions a and b which are opposite to one another, thereby providing the rotational flow 3. The installing position of the linear motors 8 and 8' in the vertical direction is illustrated in FIG. 7. The linear motors 8 and 8' installed at the position shown in FIG. 7 subject the solidification interface 2 to the strip-shaped rotational flow 3. The region of the solidification interface 2 subjected to the rotational flow in the form of a strip extends from the initiating point of solidification at the molten steel surface 1 to the position of the solidification interface 2 where the thickness of the solidification layer is more than the amount of scale off, for example, approximately 0.7 to 2.0 mm. The thickness of the rotational flow 3 having the predetermined flow speed explained hereinabove, is from approximately 10 to 20 mm.

Figure 8:
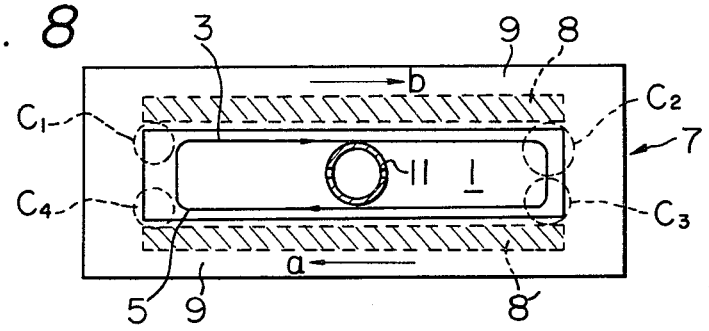
FIG. 8 is a plan view of a slab mold with four corners and illustrates a rotational flow of molten steel.

Theoretically, it is possible to subject the entire solidification interface of the region as explained above to the electromagnetic flow, but this is actually rather difficult, especially when the product to be cast is a slab having a rectangular shape in lateral cross section. In the case of a bloom or billet having a round or square cross sectional shape, a smooth electromagnetic flow can be relatively easily obtained, because of the uniform distance of the center from the wall of the mold. On the other hand, in the case of a slab, since there is a significant difference between the lengths of the long sides and short sides of the mold, and further, since the distance from the wall to the center of the mold is not uniform, the electromagnetic flow is not uniform. Furthermore, since the flow speed itself imparted to the molten steel according to the present invention is slow, the flow of molten steel may be interrupted at the four corners of the slab mold due to the stagnation of electromagnetic flow, with the result that the intended objects cannot be achieved as explained hereinafter with reference to FIG. 8. In FIG. 8, the linear motors 8 and 8' are installed along the direction of the long sides 9 of the slab mold 7, and generate propulsion forces having directions a and b opposite to one another. The stagnation may be caused at the four corners $C_1$ through $C_4$ of the slab mold 7.

In the present invention, a predetermined position of the solidification layer is stably subjected to the electromagnetic flow having a predetermined speed, without causing a disturbance of the molten steel surface and stagnation in the slab mold. These conditions of the electromagnetic flow were investigated and established as follows.

First, the present Inventors conducted detailed research on the configuration of the short sides of a slab mold having such a shape that an electromagnetic field is created without stagnation.

Figure 9:
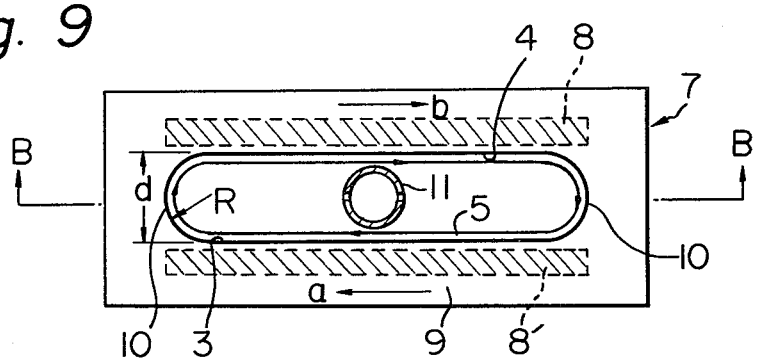
FIG. 9 is a plan view of a slab mold with a curved short side.

In FIG. 9, the short sides 10 of the mold 7 are provided with an outwardly concave or inwardly convex shape having a radius of curvature corresponding to one half the radius of curvature (R) of the effective length of the short side 10 of the mold 7. In the case of using the mold illustrated in FIG. 9, the flow of molten steel in the mold has a portion 5 as schematically illustrated in FIG. 9. When the short sides 10 have a concave shape as illustrated in FIG. 9, the flow generated at one of the long sides 9 can be satisfactorily transmitted to one of the short sides 10 with the radius of curvature (R) as shown in FIG. 9 and even to the opposite long side 9, with the consequence that a continuous horizontal rotational flow 3 without stagnation can be formed within the mold 7. The formation of the inner surface of the mold short sides in a concave form is known by itself in the continuous casting of steel from JA-OS No. 52-117234. However, JA-OS No. 52-117234 has the object of providing a solidification shell of the short sides of a slab with an arch structure and, thus, preventing the bulging of the short sides of the slab during the casting procedure. Therefore, JA-OS No. 52-117234 does not suggest the continuous horizontal rotational flow of the molten steel according to the present invention. The concave shape of the inner surface of the continuous casting mold short sides is also known from U.S. Pat. No. 2,781,562, although this patent is related to a nonferrous metal. However, the object of this patent is to decrease the solidification gap between the ingot and the mold, and thus, also does not suggest the rotational flow mentioned above.

Figure 10:
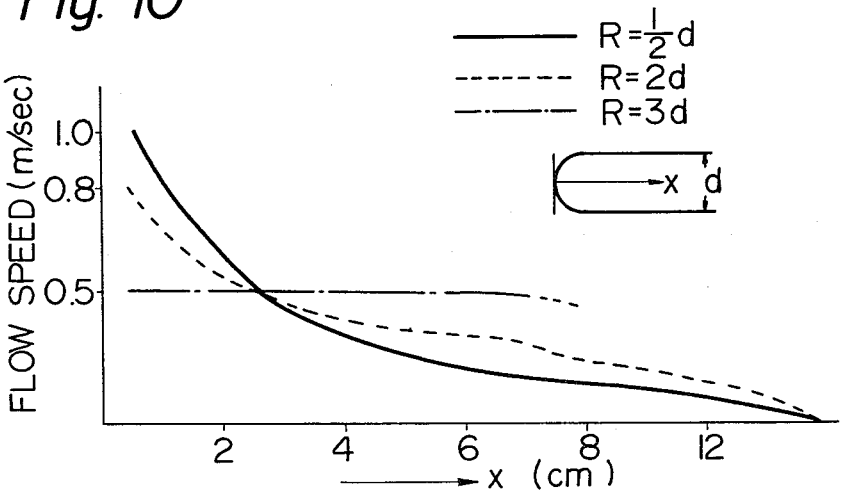
FIG. 10 is a graph of flow speed distribution along a distance (x) from one of the short sides of the mold.

Second, the present Inventors conducted research on the flow patterns obtained by using short sides of the mold having various radiuses of curvature (R). It was proven, as a result of the research, that the flow pattern equivalent to the pattern illustrated in FIG. 9 can be obtained at a radius of curvature (R) of from one half to two times the effective thickness (d) of the short sides of the strand. Referring to FIG. 10, the relationships between the flow speed and the distance x are illustrated in the cases of using various shapes of the short sides. The distance x designates the distance from one of the short sides to the center of the long sides in the direction of the long sides at the middle portion of the mold thickness or one half of the thickness (d) of the strand or the mold short sides. As seen in FIG. 10, when the radius of curvature (R) of the mold is from one half to two times the strand thickness (the solid and dotted lines), a relatively rapid flow is formed at the short sides of the mold and the flow speed becomes abruptly slow when the flow leaves the short sides. Contrary to this, when the radius of curvature (R) is three times or more the strand thickness (d) (the chain line), the flow speed is relatively decreased to less than one half of that of the two curves mentioned above, and further, there is no appreciable change in the distribution of speed in the direction toward the center of the mold long sides. These facts mean that the electromagnetic flow is effectively obtained at the solidification interface in the former two radiuses of curvature, while in the latter radius of curvature, the horizontal rotational flow exerts no appreciable influence upon the solidification interface at the short sides and is dispersed toward the interior of the mold. The dispersion of the flow in the latter case may cause disturbance of the molten steel surface or stagnation portions, with the result that the entire circumference of the solidification interface cannot be subjected to the desired electromagnetic flow. Such tendency of the horizontal rotational flow in the case of $R \leqq 3d$ is common in the conventional molds with linear short sides. The disturbance of the molten steel surface mentioned above may bring about, in turn, a nonuniform of the distribution continuous casting powder on the molten steel surface and entrapment of such powder into the molten steel, while the interruption of the electromagnetic flow due to the stagnation may bring about the formation of bubbles. As will be understood from the above explanation, in order to subject the predetermined region of the solidification interface to the electromagnetic flow, the shape or configuration of the short sides must be selected so that the radius of curvature (R) of the short sides is in the range of from one half to two times, preferably from one half to one time the strand thickness (d).

The shapes of the mold short sides as illustrated in FIGS. 11 A, B and C, are embodiments of a continuous casting mold. These concave polygon shapes can be practically employed for providing a relatively effective magnetic flow, but are not as ideal as the short sides having a radius of curvature in the range of from one half to two times the strand thickness. In short, as will be understood from FIG. 8, the stagnation is generated by the flow disturbance, which results from the flow advancing in the direction from the long to short sides and colliding against the short sides. Consequently, the entire solidification interface can be subjected to the electromagnetic flow, when the short sides of the mold are provided with a concave shape, including a concave polygon shape, so that the flow is smoothly guided from the long sides toward the short sides.

Third, the present Inventors conducted experiments regarding the installation position of the linear motors provided at both long sides of the mold, so as to stably obtain a thickness of a non-defective solidification layer which was more than the predetermined thickness. This is because, by means of only the measures explained above, which make it possible to provide the electromagnetic flow without stagnation, it is difficult to obtain the thickness of the solidificaton layer mentioned above regarding a slab and, therefore, the installation position of the linear motors is important. In the experiments conducted by the Inventors, the linear motors were installed at various depths from the position corresponding to the molten steel surface in the mold. In one experiment, the linear motors 8 and 8' were installed considerably below the molten steel surface, so that, as seen in FIGS. 12 A and B, the predetermined position of the molten steel in the mold, namely the molten steel surface, would be subjected to the electromagnetic flow. In addition, a portion of the solidification interface, which portion extends from the liquid surface down to the position where the solidification layer having a thickness of scale off is formed, was also subjected to the electromagnetic flow. Furthermore, the mold short sides had a radius of curvature (R) of from one half to two times the strand thickness (d), which radius is optimum for obtaining the electromagnetic flow without stagnation. The flow speed was slow, i.e. from 0.1 to 1.0 m/sec. Although the shape of the mold short sides was ideal and, further, the flow speed was slow, the obtained force of electromagnetic flow 13 was directed not in the horizontal rotating direction but in the directions from both of the mold short sides toward the mold center. Due to the directions of the electromagnetic flow mentioned above, the continuous casting powder 14 on the molten steel surface is gathered up toward the center of the molten steel surface, with the consequence that no powder is present on the molten steel surface at both short sides. Normal powder casting cannot, therefore, be carried out and such accidents as breakout are caused by the electromagnetic flow as explained above. The phenomenon of the gathering up of the continuous casting powder is caused by the upward components 15, as explained with reference to FIG. 12B, which illustrates a vertical cross sectional view of the mold. In FIG. 12B, the linear motors 8 and 8' are installed at such a depth from the molten steel surface 1 that the components of the electromagnetic flow in the laminar form along the long sides are not transmitted satisfactorily to the molten steel surface. When these components of the electromagnetic flow collide against the short sides, these components are divided into upward components 15 and downward components 16. In a case where the upward components 15 are stronger than the horizontal electromagnetic flow 3, the phenomenon mentioned above appears.

As will be understood from this explanation, if the linear motors 8 and 8' are installed below a certain position, the horizontal electromagnetic flow 3 tends to be weak, while the upward components 15 of the flow, which later advance from the short sides to the center of the mold, tend to be strong and the most influential. Therefore, in the present invention the linear motors are installed as close as possible to the molten steel surface, provided that the installing position of the linear motors is within the range in which the non-defective solidification layer having a thickness corresponding to the thickness of scale off mentioned above is provided.

According to research conducted by the present Inventors, the phenomenon illustrated in FIGS. 12A and B is conspicuous when the installing position of the linear motors is 150 mm or more from the molten steel surface and is particularly pronounced at 200 mm or more from the molten steel surface. Therefore, the linear motors are preferably installed at a distance from the molten steel surface of less than 200 mm, more preferably less than 150 mm. These distance values can be applied for the linear motor installation in almost all molds and are not dependent on the size of the mold.

In the arrangement as illustrated in FIG. 13A, the short sides of the mold are provided with a radius of curvature (R) which is from one half to two times the strand thickness (d) as mentioned hereinabove, and in the arrangement illustrated in FIG. 13B the linear motors 8, 8' are installed in the range of from 150 to 200 mm below the molten steel surface, e.g., 150 mm. The flow pattern obtained by the mold and the linear motors illustrated in FIGS. 13A and 13B is illustrated in FIG. 13A. The electromagnetic flow without stagnation, which flow causes no disturbance at predetermined positions of the molten steel surface as can be understood from FIG. 13A, is not obtained unless both an ideal shape of the short sides and an optimum installing position of the linear motors are provided. The pattern of electromagnetic flow in FIG. 13A causes no disturbance of the continuous casting powder on the molten steel surface, because the horizontal electromagnetic flow 3, which will later collide against the short sides 10, is sufficiently strong for: not causing disturbance of the powder on the molten steel surface, and; obtaining an electromagnetic flow 3 which is continuously distributed only on the solidification interface. Furthermore, the downward components 16 of the electromagnetic flow are at a position below a portion of the solidification interface, which portion is to be subjected to the electromagnetic flow. These downward components do not, therefore, exert an undesirable influence on the formation of the non-defective solidification layer.

When the linear motors are installed at a position approximately 100 mm below the molten steel surface, such installing position does not always lead to serious accidents, such as breakout, in the case of a conventional flat shape of the short sides. However, it cannot definitely be said that no danger of these accidents exists, because the liquid pool slightly swells at the short sides, due to the flat shape thereof, when the electromagnetic flow collides against the flat short sides, and; as a result, the supplied amount of the continuous casting powder may be too low at the swelled portion of the liquid pool.

As explained in detail above, in order that neither disturbance of the molten steel surface nor stagnation are caused, and further, that the predetermined region of the solidification interface is subjected to the continuous electromagnetic flow, both the shape of the short sides of the mold and the installing position of the linear motors should satisfy the conditions in accordance with the present invention.

In an ideal embodiment of the present invention, the linear motors are installed in a cooling box of the mold, in such a manner that the centers of the cores of the linear motors are located at the level of the molten steel surface. In addition, the continuous casting operation is carried out in such a manner that: the region of the liquid pool influenced by the laminar flow, which is caused by the linear motors, extends as deep as 200 mm from the molten steel surface, and; the flow speed of the electromagnetic flow 3 is in the range of from 0.1 to 1.0 m/sec in this section.

Actually, the linear motors at the ideal position mentioned above may pose an installation difficulty. Furthermore, a disadvantage is involved in the flow speed in the range of from 0.1 to 1.0 m/sec at a depth of 200 mm from the molten steel surface. It is, therefore, practically advisable to install the linear motors in such a manner that the centers of the cores of the linear motors are positioned approximately 200 mm below the molten steel surface, thereby utilizing upper and lower laminar flows for realizing the influence mentioned above. In this installation, the interface between the liquid pool and the solidification layer having a thickness of up to 5 mm is effectively subjected to the continuous electromagnetic flow having a speed in the range of from 0.1 to 1.0 m/sec, while neither disturbance of the molten steel surface nor stagnation are caused. Since the main object of the present invention is to obtain a non-defective solidification layer at the required minimum region of the solidification interface, as will be understood from the explanation above, the number of linear motors arranged in a vertical direction may be one or more.

One important aspect of the present invention will now be explained. Referring to FIG. 14, the progress of solidification at the solidification interface, which is to be subjected to the electromagnetic flow of molten steel, is delayed (indicated by the broken line) as compared with the progress of solidification of the conventional process without electromagnetic flow (the solid line). In order to obtain a non-defective solidification layer having a required thickness, it is necessary to deepen the position of the electromagnetic flow as compared with such position in the conventional method. In this regard, the relationship between the elecromagnetic flow and the streams of molten steel ejected from an immersion nozzle which is used for pouring the molten steel into the mold, is important from a practical point of view. Since the process of the present invention is based of powder casting, an exposed casting stream cannot be employed for pouring in the present invention. If so called open pouring is used, disturbance of the continuous casting powder is caused during the pouring of the molten steel into the mold. Therefore, the immersion nozzle, namely the immersion type pouring nozzle, which is immersed into the molten steel in the mold, is indispensable in the process of the present invention.

Referring to FIG. 9, the linear motors 8 and 8' are installed in the cooling boxes of the mold 7 for a slab along the long sides thereof. The solidification interface, where the thickness of the solidification layer is equal to or less than the thickness of scale off, is subjected to the electromagnetic flow, which is generated by the propulsion force of the linear motors in directions a and b opposite to each other. In accordance with the present invention the electromagnetic flow is generated in such a manner that the streams ejected from the immersion nozzle 11, for pouring the molten steel into the mold, do not impede the electromagnetic flow, to which the solidification interface mentioned above is subjected. Regarding a conventional immersion nozzle, the outlet ports of such a nozzle coincide in most cases with the position of forming the electromagnetic flow. If this conventional immersion nozzle is used in the present invention, the electromagnetic flow, which is slow so as not to cause the disturbance of the molten steel surface within the mold, is impeded by the streams ejected from the immersion nozzle. Namely, the electromagnetic flow is formed only partially due to the influence of the ejected stream. It is to be noted in this regard that, at the region of the solidification interface, where the thickness of the solidification layer is equal to or less than the thickness of scale off, the progress of solidification is delayed due to the electromagnetic flow, to which this region of solidification interface is subjected, as seen in FIG. 14, wherein the solid and dotted lines indicate casting without and with electromagnetic flow, respectively. Accordingly, if the influence of the ejected streams exists as mentioned above, the suppresion of the nuclei of bubbles and the formation of a psuedo-rimmed layer are only partially achieved. This fact is the result of the generation of a stagnation portion of the electromagnetic flow. Due to such stagnation portion, it is impossible to form the filmy, electromagnetic flow, which must be continuous along the solidification interface so as to form a non-defective solidification layer around the entire surface of the strand. The electromagnetic flow, which is disadvantageously discontinuous, is formed during the casting whether the ejected streams of molten steel are directed to the short or long sides of the mold, although the degree of discontinuity varies according to the direction of the streams. However, if the flow speed of the electromagnetic flow is high, the elimination of the disadvantage mentioned above might seem to be possible. When the flow speed of the electromagnetic flow is, however, adjusted to exclude the influence by ejected streams mentioned above, the stagnation disappears but disturbance of the molten steel surface is caused. This is because the collision force of the electromagnetic flow against the walls is large, since the flow speed of the entire flow is high. As a result, the upward components of the flow are so strong that they are stronger than the horizontal electromagnetic flow. When the disturbance of the molten steel surface is caused, due to the upward components, the merits of the powder casting are lost. In accordance with the present invention, the ejecting position of the immersion nozzle is set deeply within the liquid pool by means of: providing the immersion nozzle with a relatively large length; orienting the ejecting direction of the immersion nozzle downwardly or; a combination of a relatively long nozzle and a downward ejecting direction. As a result of such adjusting methods, the electromagnetic flow mentioned above is formed between the molten steel surface and the streams ejected from the immersion nozzle, thereby not allowing the stream ejected from the immersion nozzle to impede the electromagnetic flow, which is required for forming the non-defective solidification layer having a predetermined thickness.

A continuous casting apparatus according to an embodiment of the present invention is illustrated in FIG. 15 in the form of a cross sectional view along line B—B of FIG. 9. As seen in FIG. 15, the linear motors 8 and 8' (broken lines) are installed at a portion of the mold corresponding to a level between the molten steel surface 1 in the mold 7 and the ejected streams 17. The output of the linear motors 8 and 8' is adjusted so as to: subject a region of the solidification interface to a continuous electromagnetic flow; form the solidification layer free from blowholes, and; extend the region of the solidification interface mentioned above from the molten steel surface to a portion of the solidification interface where the thickness of the solidification layer is equal to the thickness of scale off. The position of the streams 17 ejected from the immersion nozzle 11 is below the electromagnetic flow.

In addition to the installing position of the linear motors 8 and 8' as illustrated in FIG. 15, the linear motors may be installed at such positions as illustrated in FIGS. 16 and 17. In FIG. 16, the linear motors 8 and 8' are installed at the level of the molten steel surface 1, and in FIG. 17 the linear motors 8 and 8' are installed over the mold region extending from the molten steel surface 1 to the position of the streams ejected from the immersion nozzle 11. In both FIGS. 16 and 17, the installing position of linear motors 8 and 8' extends from the molten steel surface 1 to a position above the ejected streams 17, so as to thereby obtain a predetermined thickness of the non-defective solidification layer at a predetermined region of the solidification interface.

When the position of the ejected streams 17 is 300 mm below the molten steel surface 1, the installing position of the linear motors as illustrated in FIG. 15 may be from 10 to 20 mm below the molten steel surface. In this installation of the linear motors, a 2–4 mm thick non-defective solidification layer having a thickness more than the thickness of scale off is secured by the effects of the electromagnetic flow, while the ejected streams 17 exert no influence on the growth of the solidification layer.

In practicing the process of the present invention, the direction of streams 17 ejected from the immersion nozzle is important. In this regard, it is possible to use the following measures employed in the art of continuous casting. According to these measure the upward flow is generated as low as possible from the stream which is ejected from the immersion nozzle and then collides against the walls of the mold, and the outlet ports of the immersion nozzle are provided with such an angle that the horizontal rotational flow which is formed above the ejected streams is not disturbed. As a result, it is possible to bring streams 17 ejected from the immersion nozzle close to the molten steel surface. The ejected streams mentioned above may be horizontal, as illustrated in FIGS. 15, 16 and 17, or may be oriented in a downward direction, as illustrated in FIG. 18. The ejected streams 17 of FIG. 18 are particularly preferable.

It is preferable to adjust the concentration of free oxygen in the molten steel so that it is within the range of from 50 to 150 ppm, athough the free oxygen concentration may be in the range of from 50 to 200 ppm, as mentioned above. When the free oxygen concentration is in the range of from 50 to 150 ppm, the generation of the nuclei of bubbles can be reliably suppressed by means of an electromagnetic flow of molten steel having a flow speed in the range of from 0.1 to 1.0 m/sec, preferably from 0.5 to 0.8 m/sec.

The solidification interface, which should be subjected to the horizontal electromagnetic flow of molten steel, extends from the molten steel surface to a portion of such interface where the thickness of the solidification layer formed from the molten steel is at least 5 mm. In order to subject such solidification interface to the horizontal electromagnetic flow having an almost constant flow speed in the range of from 0.1 to 1.0 m/sec, preferably from 0.5 to 0.8 m/sec, the following operating conditions of the linear motors can be used. The frequency of the electric current conducted through the coils of the linear motor can be from 1 to 10 Hz and the product of the electric current value and number of turns of coils in terms of amperes.turn is from 1500 to 7000 amperes.turn. It is assumed in setting this condition that the thickness of the copper plate of the long sides of the mold is as small as possible, for example from 5 to 12 mm. It is preferable to provide the flow of molten steel with such a distribution of flow speed that the flow speed at the required position in the mold, i.e., at the solidification interface, falls within the range of the flow speed mentioned above, while the flow speed at the inner position within the required position is extremely slow. Such distribution of the flow speed can be obtained by adjusting the frequency of the electric current through the linear motors, so that the frequency is within the range of from 1 to 10 Hz, for example, from 3 to 10 Hz. Due to this high frequency the output of the linear motors tends to be relatively low, so that it is difficult to obtain the flow speed of from 0.1 to 1.0 m/sec, particularly from 0.5 to 1.0 m/sec. Accordingly, the electric current should be adjusted in such a manner that a high magnetomotive force in the range mentioned above, for example, from 4000 to 7000 amperes.turn, makes up the deficit of the output.

As will be understood from the above explanation, in a continuous casting process for the steel slab, based on the employment of continuous casting powder and a nozzle immersed in the molten steel in the mold, the improvement according to the present invention comprises: casting a molten steel containing free oxygen at a concentration in the range of from 50 to 200 ppm, preferably from 50 to 150 ppm; not allowing an ejected stream of molten steel from the outlet ports of the immersion nozzle to exert an undesirable influence on the electromagnetic flow of molten steel, and; subjecting a predetermined region of the solidification interface to the electromagnetic flow. Since there is no undesirable influence on the electromagnetic flow, the powder casting process conducted by using an immersion nozzle is not impeded at all and a slab without blow holes on the surface thereof can be stably cast.

In order to form the non-defective solidification layer without blow holes on the surface of the strand and to cause no disturbance of the continuous casting powder on the molten steel surface, the filmy rotational flow of molten steel is formed around the entire solidification interface at the liquid pool in the upper portion of the mold, and is provided with a strip form, which has a short side in the vertical direction of the liquid pool. Namely, the filmy rotatinal flow of molten steel having the required flow speed is formed at a limited portion of the liquid pool adjacent to the mold walls, while in the other portion, i.e., the center portion of the liquid pool, the molten steel flows slowly or almost not at all. It is, therefore, possible to industrially conduct the continuous casting of the incompletely deoxidized steels or the slightly deoxidized steels, which correspond to the rimmed and semi-killed steels.

When practicing the process of the present invention, attention should be paid to the distance L (FIG. 19) between the immersion nozzle 11 for pouring the molten steel into the mold and the walls of the long sides 9 of the mold. When the distance L is less than 20 mm, the resistance against the flow, which is provided with the predetermined flow speed in a portion of the molten steel surface adjacent to the mold walls, is so high that a smooth flow cannot always be achieved. The distance L should, therefore, be 20 mm or more. The maximum distance L is ordinarily determined in accordance with the size of the mold, diameter of the immersion nozzle and the like.

Since streams ejected from the immersion nozzle have an influence upon the filmy rotational flow, the ejected streams 17 are directed below the filmy rotational flow so as to reduce such influence. It is possible to effectively eliminate the remaining influence of the ejected streams directed below the filmy rotational flow by ejecting the streams from outlet ports 13 as shown in FIG. 20. The streams ejected from the immersion nozzle 11 are directed in almost the same direction as the direction of the rotational flow.

The present invention will now be explained further in detail by way of an example and control examples. In these examples the heats 1 and 2, corresponding to the rimmed steel, and the heats 3 and 4, corresponding to the semi-killed steel, as illustrated in the table below, were continuously cast. The oxygen concentrations as shown in the table were obtained by the use of a deoxidant in heats 1 and 2 and by vacuum degassing in heats 3 and 4.

TABLE

| Heat | C (%) | Si (%) | Mn (%) | P (%) | S (%) | So Al (%) | O (ppm) | Temperature in Tundish (°C.) |
|---|---|---|---|---|---|---|---|---|
| 1 | 0.05 | tr. | 0.12 | 0.013 | 0.015 | tr. | 150 | 1550 |
| 2 | 0.06 | tr. | 0.12 | 0.012 | 0.020 | tr. | 200 | 1550 |
| 3 | 0.15 | 0.15 | 0.60 | 0.013 | 0.012 | 0 | 75 | 1530 |
| 4 | 0.20 | 0.16 | 0.57 | 0.011 | 0.011 | 0 | 70 | 1530 |

EXAMPLE

The steel of each heat number was cast under the following conditions.

Shape of mold: short sides were arched with a radius of curvature (R) equal to one half of the strand thickness.

Size of mold: 250 mm in thickness and 2100 mm at maximum length.

Casting speed: 0.7 m/min.

Installing position of the linear motors: the centers of the linear motors were 200 mm below the molten steel surface.

Immersion nozzle: the immersion nozzle had an outer diameter of 100 mm and was disposed at the center of the mold; the jetting position was 250 mm below the molten steel surface, and; the ejecting direction was toward the short sides.

Frequency of Electric Current: 5 Hz.

Magnetomotive force: 380Ax18 turns

State of rotational flow of molten steel: the effective thickness of flow was from 10 to 20 mm; the effective depth of flow was from the molten steel surface to a position 200 mm below the molten steel surface; the thickness of the solidification layer 200 mm below the molten steel surface was from 0 to 3 mm, and; the flow speed was from 0.5 to 0.8 m/sec.

The continuous casting powder:

| | | |
|---|---|---|
| (1) | $CaO/SiO_2$ | = 1.0 |
| | $Al_2O_3$ | = 10% |
| | $Na^+$ | = 3.5% |
| | $K^+$ | = 2.5% |
| | $F^-$ | = 4% |
| | C | = 4.5%; |

(2) viscosity of 2.3 Poise at 1500° C., and;

(3) melting point of 1150° C.

In casting the heats 1 through 4, strands having a non-defective solidification layer could be obtained without causing the entrapment or disturbance of the continuous casting powder on the molten steel surface in the mold. The traverse cross sectional macro-structure of the produced strands of the heats 1 through 4 was investigated. It was proven that a 3 mm thick non-defective solidification layer was uniformly formed around the entire surface of the strands of all of heats 1 through 4. Blow holes were present inside the non-defective solidification layer.

The strands in the form of a slab, which were produced from the heats 1 through 4, were reheated and hot rolled by a conventional process. Some of the strands were then cold rolled by a conventional process. No surface defects were detected in any of the final products so rolled.

CONTROL EXAMPLE 1

Molten steel having the same composition as that of the heats 1 through 4 was cast under the same casting conditions as in the Example, except that the area of horizontal rotational flow was extended to the center of mold, and further, that the flow speed at the walls of the mold was approximately 3.0 m/sec. The flow speed of the horizontal rotational flow was 1.0 m/sec.

The molten steel surface was vigorously disturbed and the continuous casting powder finally gathered in the center of the mold. Since the danger of breakout became high, the casting had to be terminated. Regarding the cast strands, the structure thereof was observed after solidification. It was proven that the continuous casting powder was entrapped into a considerable number of the stands. In the present control example, the continuous casting powder was disturbed due to the rotational flow extending even to the center of mold.

CONTROL EXAMPLE 2

Molten steel having the same composition as that of the heats 1 through 4 was cast under the same condition as in the Example, except that the flow speed of the rotational flow was from 0.1 to 1.0 m/sec and, further, the filmy rotational flow was not imparted to a portion of the molten steel adjacent to the molten steel surface. Blow holes or pinholes were detected on the surface of all of the strands. After the casting, the strands were charged into a heating furnace and then rolled, thereby obtaining the final products. Numerous surface defects were generated on the final products and recovery of the final products was, therefore, too low. It is believed that in the present control example, wherein the rotational filmy flow for suppressing the generation of nuclei of bubbles was not imparted to the molten steel surface, the generation of bubbles could not be suppressed at the outer surface layer adjacent to the molten steel surface and the bubbles were thus generated.

CONTROL EXAMPLE 3

Molten steel having the same composition as that of the heats 1 through 4 was cast under the same condition as in the Example, except that the short sides of the mold were flat in shape as in a conventional mold. The continuous casting powder was finally collected at the center of the mold and, therefore, the danger of breakout arose. The casting was then conducted without the propulsion force of the linear motors, which were stopped in the course of the casting. As a result, numerous pinholes were generated on the surface of the strands and, therefore, the recovery was extremely low.

CONTROL EXAMPLE 4

Molten steel having the same composition as that of the heats 1 through 4 was cast under the same condition as in the Example, except that the installing position of the linear motors was 250 mm and 300 mm from the molten steel surface. The molten steel surface was vigorously disturbed and the state of the molten steel surface was similar to that in Control Example 3.

CONTROL EXAMPLE 5

Molten steel having the same composition as that of the heats 1 through 4 was cast under the same condition as in the Example, except that the length of the immersion nozzle was changed as follows and, further, the flow speed was more than 1.0 m/sec with regard to the molten steel having the composition of heats 2 and 4. The length of the immersion nozzle was changed from that in the Example, so that the upper surface of the ejected streams was 100 mm below the molten steel surface. As a result of the casting, numerous pinholes 18 were generated at portions denoted by P on the strands 4 as shown in FIG. 21, which schematically illustrates the strand. It is believed that such defects result from stagnation and discontinuity of the electromagnetic flow, due to the influence of the ejected streams from the immersion nozzle.

The solidification interface could, therefore, not be subjected to the continuous electromagnetic flow. Regarding the molten steel having the composition of heats 2 and 4, the disturbance of the molten steel surface was so serious that the danger of breakout arose. The casting was then conducted without the propulsion force of the linear motors, which were stopped in the course of the casting. As a result, numerous pinholes were generated on the strand and the recovery was, therefore, extremely low.

CONTROL EXAMPLE 6

Molten steel having the same composition as that of the heats 1 through 4 was cast under the same condition as in the Example, except that the short sides of the mold which was used were flat, as in a conventional mold and, further, the flow speed of the electromagnetic flow was 0.2 m/sec and 1.3 m/sec with respect to the molten steel having the composition of the heats 2 and 4. When the molten steel having the composition of the heats 1 and 2 was cast at a casting speed of 1.3 m/sec, the molten steel surface was seriously disturbed, and the continuous casting powder gathered at the center of the mold. Therefore, the danger of breakout arose.

The casting was then conducted without the propulsion force of the linear motors, which were stopped in the course of the casting. As a result, numerous pinholes were generated on the strands and the recovery was, therefore, extremely low. Regarding the molten steel having the composition of the heats 2 and 4 cast at a speed of 0.2 m/sec, numerous pinholes were generated at diagonally opposite portions of the short sides of the strands. It is believed that the generation of pinholes resulted from the flat shape of the short sides and low flow speed, which cause stagnation, and hence, discontinuity of the electromagnetic flow along a solidification interface.

CONTROL EXAMPLE 7

Molten steel having the same composition as that of the heats 1 through 4 was cast under the same condition as in the Example, except that the flow speed of the horizontal rotational flow at the molten steel surface within the mold was 0.1 m/sec or less. Large blow holes were generated even on the surface of the slabs, which were obtained from the molten steel having the composition of the heats 1 and 2. Therefore, these slabs could not undergo the subsequent processing. On the other hand, pinholes were detected in all of the surfaces of the slabs, which were obtained from the molten steel having the composition of the heats 3 and 4. Surface flaws were numerously generated on the final products produced from these slabs, so that the recovery was extremely low. In the present control example, the flow speed of the horizontal rotational flow in the mold was not sufficiently high to prevent the generation of nuclei of bubbles. As a result, surface blow holes were generated.

CONTROL EXAMPLE 8

Molten steel having the same composition as that of the heats 1 through 4 was cast under the same condition as in the Example, except that the flow speed of the horizontal rotational flow at the molten steel surface within the mold was changed to 1.0 m/sec or more. Longitudinal cracks were generated sporadically on the surface of the slabs, which were obtained from molten steel having the composition of the heats 1 through 4. No matter how small the dimensions of the longitudinal cracks were, the slabs were subjected to scarfing, and the scarfed slabs were subsequently subjected to conventional processing. Surface flaws were generated sporadically on the surfaces of the resultant final products, so that the recovery was low. It is believed that the generation of the surface flaws resulted from secondary flaws which were formed due to the scarfing of large longitudinal cracks in the slab stage. It was observed at the casting of the present control example that the continuous casting powder tended to collect at the center of the mold due to the strong rotational flow. As a result, the lubrication effect of the continuous casting powder was not provided and longitudinal cracks were generated.

CONTROL EXAMPLE 9

Molten steel having the same composition as that of the heats 1 through 4 was cast under the same condition as in the Example, except that the solidification interface where the solidification thickness was not more than 1.0 mm was subjected to the electromagnetic flow having a flow speed of from 0.1 to 0.4 m/sec. The output of the linear motors was adjusted to provide this electromagnetic flow. In the present control example, in all the molten steel having the composition of the heats 1 through 4, the continuous casting powder was not disturbed, and the thickness of the obtained non-defective solidification layer was 0.5 mm. The strands obtained by the casting were subjected to the conventional processing to produce the final products. Prior to charging the strands into a heating furnace, the blow holes were exposed. Due to a conditioning of the strands, the recovery became extremely low. This is because a non-defective solidification layer thicker than the amount of scale off during the processing after the casting was not obtained.

What we claim is:

1. A process for the continuous casting of a slab of slightly deoxidized steel, using a continuous casting powder and an immersion nozzle which is immersed into molten steel within a mold having two short sides and two long sides, which process comprises the steps of:

casting into said mold molten steel having a concentration of free oxygen in the range of from 50 to 200 ppm, providing the inner surface of both short sides of said mold with a concave shape, as viewed in a horizontal cross section of said short sides, locating a device for generating an electromagnetic force at each of both long sides of said mold and above an outlet port of said immersion nozzle, orienting the propulsion force of said device for generating the electromagnetic force in directions along said long sides opposite to one another, energizing said device for generating a flow of said molten steel having an essentially constant flow speed, said flow horizontally rotating entirely around a solidification interface and in the proximity thereof, said solidification interface being the interface between a solidification layer of the steel and said molten steel, said flow being formed from the position of the molten steel surface within the mold to the proximity of a predetermined vertical position on said solidification interface where the thickness of said solidification layer is greater than the amount of scale off, and providing said horizontal flow with a flow speed in the range of from 0.1 to 1.0 m/sec.

2. A process according to claim 1, wherein said horizontal flow extends from said molten steel surface to a position approximately 50 to 200 mm below said molten steel surface.

3. A process according to claim 1, wherein the thickness of said horizontal flow, measured in the direction extending inwardly from the inside surface of said mold, is from 10 to 20 mm.

4. A process according to claim 1, wherein the distance between the periphery of said immersion nozzle and each of the walls of the long sides of said mold is at least 20 mm.

5. A process according to claim 1, wherein said flow speed is in the range of from 0.5 to 0.8 m/sec.

6. A process according to claim 1, wherein at said predetermined vertical position on said solidification interface, a solidification layer having a thickness of at least 0.7 mm is formed.

7. A process according to claim 1 or 3, wherein said device for generating an electromagnetic force is a linear motor.

8. A process according to claim 4, wherein said linear motor is installed within a cooling box along each of both long sides of said mold, and the centers of the cores of said linear motor are in the proximity of said molten steel surface.

9. A process according to claim 1 or 3, wherein said concave shape of the short sides is a circularly curved shape, with a radius of curvature in the range of one half to two times the thickness of the short sides of the mold.

10. A process according to claim 1, wherein a deoxidant is used to obtain said concentration of free oxygen in the molten steel.

11. A process according to claim 1, wherein a vacuum degassing process is used to obtain said concentration of free oxygen in the molten steel tapped from a steel making vessel.

* * * * *